United States Patent [19]

Chow

[11] 4,174,037

[45] Nov. 13, 1979

[54] SPACE-CONSERVING SKIN-PACKED ASSEMBLY

[75] Inventor: Kirk K. Chow, Dallas, Tex.

[73] Assignee: National Hand Tool Corporation, Dallas, Tex.

[21] Appl. No.: 928,547

[22] Filed: Jul. 27, 1978

[51] Int. Cl.[2] ..... B65D 85/28

[52] U.S. Cl. ..... 206/378; 206/471; 206/45.34

[58] Field of Search ..... 206/378, 471, 45.34

[56] References Cited

U.S. PATENT DOCUMENTS

| | | | |
|---|---|---|---|
| 2,980,245 | 4/1961 | Stoker, Jr. | 206/471 |
| 3,096,877 | 7/1963 | Skarsten | 206/378 |

*Primary Examiner*—George T. Hall

*Attorney, Agent, or Firm*—Michael G. Berkman

[57] ABSTRACT

A packaging assembly in which hardware items such as hand tools are secured in place on a supporting base or board by means of skin packing techniques, the final package to be inserted into a container such as a metal tool box. The invention is characterized in that the skin packing is carried out so that the bonding of the overlying film is effected in opposed marginal areas, these areas then being folded underneath the supporting board on which the tools are secured so that, in the final assembly, which is to be inserted in a tool box, there is no "waste" space, the entire floor area being occupied by tool elements.

7 Claims, 12 Drawing Figures

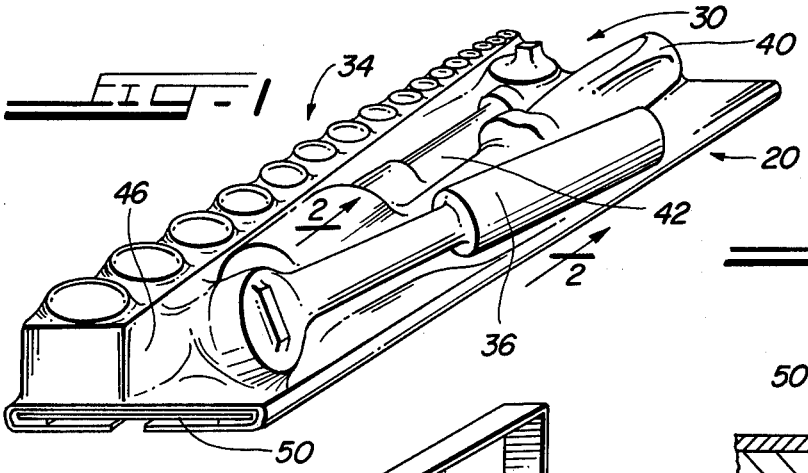
FIG-1
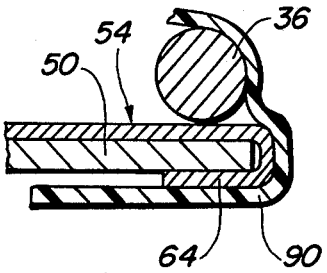
FIG-2
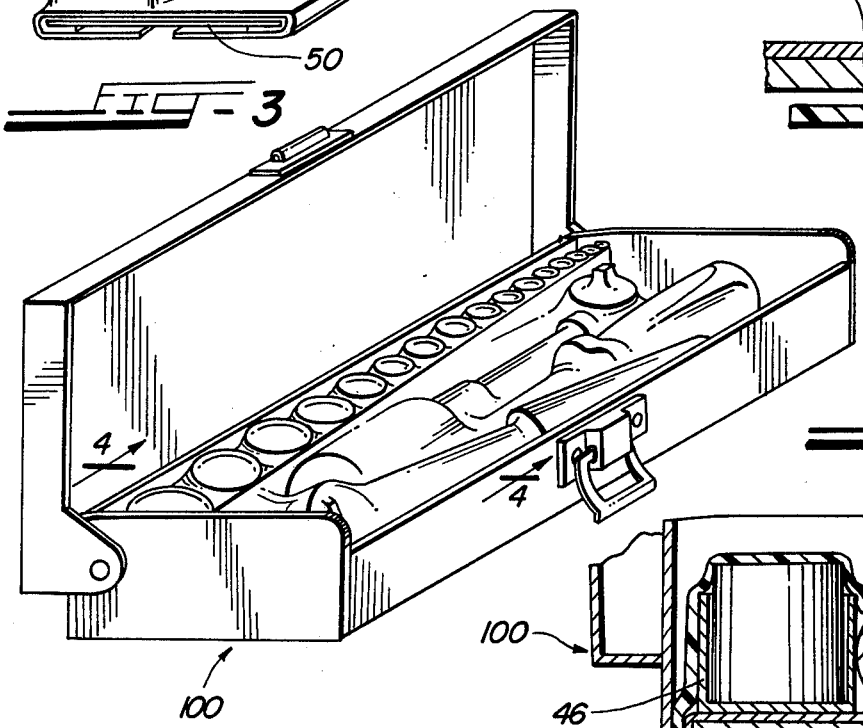
FIG-3
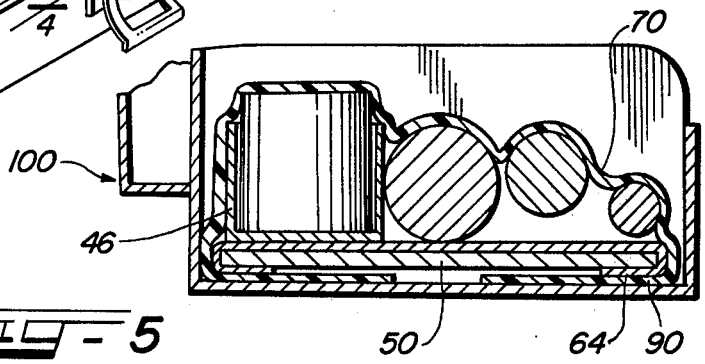
FIG-4
FIG-5
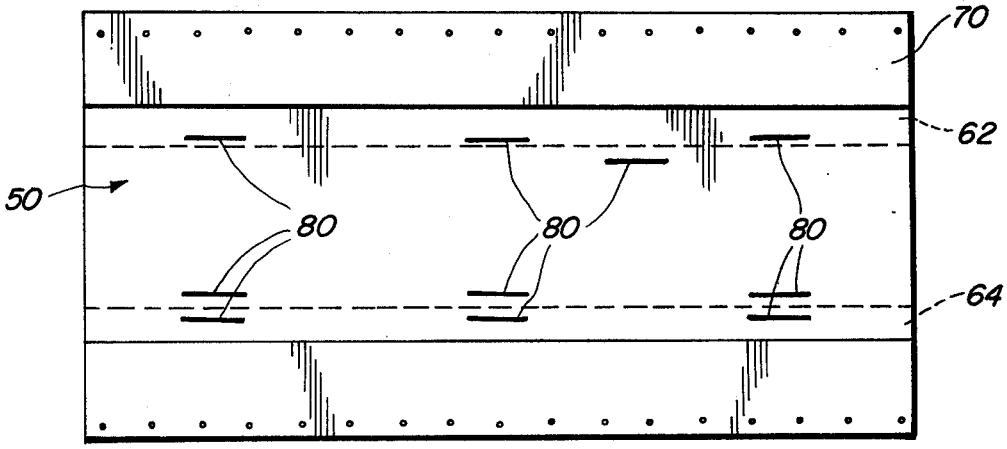

FIG. 6
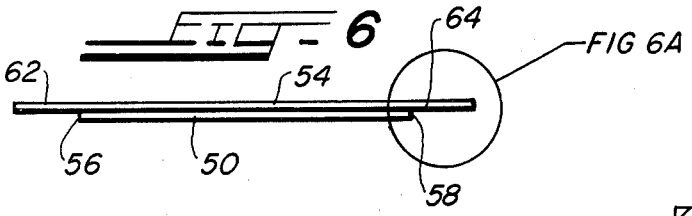
FIG. 6A
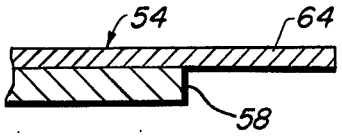
FIG. 7
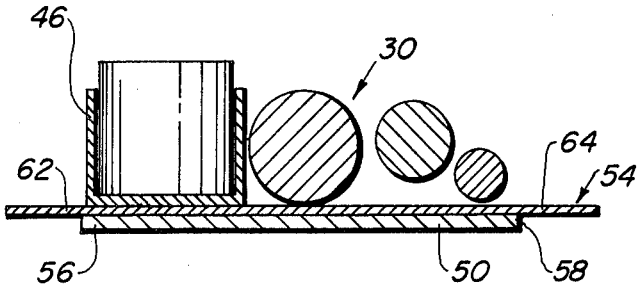
FIG. 8
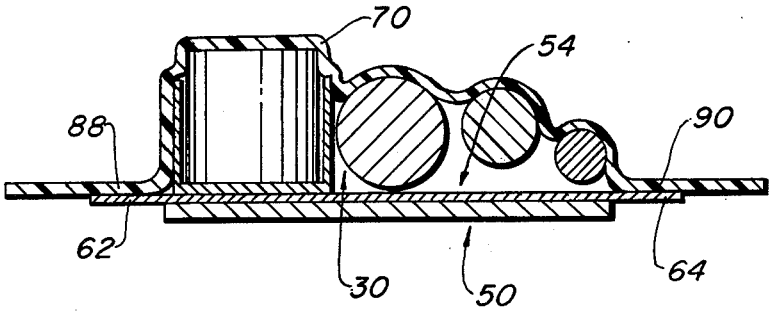
FIG. 9
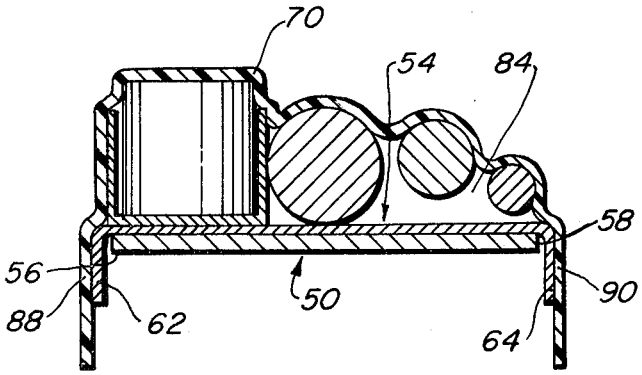
FIG. 10
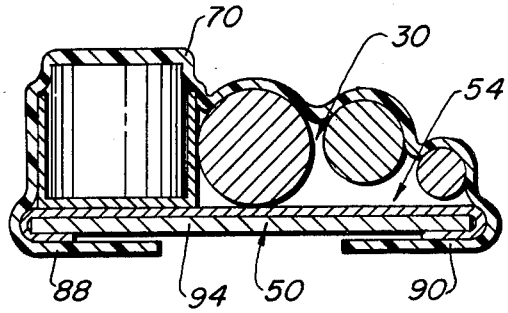
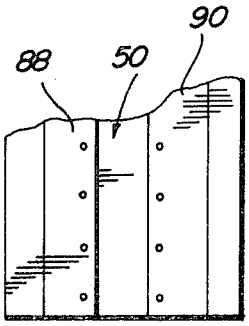
FIG. 11

SPACE-CONSERVING SKIN-PACKED ASSEMBLY

BACKGROUND OF THE INVENTION

The present invention relates to an improved skin package assembly of the type widely employed in the display and protection of articles including tool elements such as wrench and socket sets.

More particularly, the invention finds utility in the packaging of such tool items as are ultimately to be contained in a metal tool box or the like, as a composite display sealed to maintain an ordered arrangement and to minimize pilferage.

Heretofore, it has been the practice, in the preparation of skin packed assemblies for ultimate insertion into principal containers such as metal tool boxes, to provide boxes which are considerably larger in floor area than the actual area occupied by the tools themselves. This has been deemed necessary in order to accommodate the marginal sealing zones in which the transparent plastic film is bonded to the underlying tool supporting substrate. It is to a simple yet unobvious improvement in packaging so as to effect material conservation of space and to obviate wasted space that the instant invention is directed.

SUMMARY OF THE INVENTION

It is a principal feature of the present invention that there is provided an improved packaging assembly of the type using "skin packing" techniques but in which certain disadvantages of the technique have been avoided.

Specifically, it is an important feature of the present invention that the tools or other items which are secured in place on the backing member occupy substantially the entire floor area of that backing member.

The subject invention finds particular utility in the packaging of tool elements such as socket sets and drives which are, subsequent to the skin packaging, inserted into metal tool boxes or equivalent structures for display and sale.

In accordance with the practice of the invention, the skin packed assembly does not require a tool box floor area which exceeds to any substantial extent the actual floor area occupied by the tool elements themselves. That is, the necessity of accommodating peripheral sealing zones extending beyond the actual area occupied by the tool elements has been obviated.

A related object of the invention is that the tool elements of the skin pack will, upon removal of the packaging film, fit precisely in the metal tool box provided, with precision and organization, there being no unnecessary, superfluous space. The final article consisting of the tools in combination with the tool box is not only functionally precise, but is neat in appearance both prior to and after removal of the skin packaging.

It is a related feature of the invention that the tool components set forth for display in the tool box fit snugly within the box, in the skin packed state of the assembly as well as when the disposable components of the skin packaging are discarded.

It will be readily appreciated that the improved packaging assembly of the present invention has all of the advantages heretofore associated with skin packaged displays, and, in addition, the advantage of important space saving, as well as enhanced appearance.

It has invariably been the practice in the prior art in carrying out skin packing, that the bonded overlying transparent sheet material engages the backing member in a zone which extends laterally about the entire periphery of the article encased so that the backing member projects well beyond the actual physical limit of the article or articles themselves. In accordance with the practice of the present invention, objectionable extravagance and space wasting are avoided.

Other and further objects, features, and advantages of the invention will become evident upon a reading of the following specification taken in conjunction with the drawings.

BRIEF DESCRIPTION OF THE DRAWINGS

FIG. 1 is a perspective view of a socket set and drive bars skin packed in accordance with the present invention;

FIG. 2 is an enlarged, fragmentary view of a portion of the package assembly of the invention illustrating the manner in which the floor sheet, with the shrink film bonded thereto, is folded underneath to underlie the baseboard;

FIG. 3 is a perspective view of the skin package of FIG. 1 displayed in a tool box;

FIG. 4 is a cross-sectional view taken substantially on the lines 4—4 of FIG. 3 and showing the close spatial correspondence between the tool element, packaged in accordance with the invention, and the containing tool box;

FIG. 5 is a bottom plan view of the package assembly of FIG. 1;

FIG. 6 is an end view of the floor sheet and the underlying baseboard in accordance with the invention;

FIG. **6*a* is an enlarged fragmentary view of the encircled portion of FIG. 6**, showing the overlying floor sheet extending laterally beyond the underlying baseboard;

FIG. 7 is an end elevational view illustrating the placement of tool components on the floor sheet of the package of the invention, in a zone overlying the baseboard;

FIG. 8 is an end elevational view similar to that depicted in FIG. 7, but illustrating the placement and secured attachment of a transparent plastic sheet over the tool elements and bonded to the floor sheet in accordance with the invention;

FIGS. 9 and 10 illustrate two successive stages in the packaging method of the invention whereby the peripheral margin of the floor sheet, with the shrink film bonded thereto, is folded around and under the baseboard to provide the composite, space-saving assembly of the invention; and FIG. 11 is a fragmentary bottom plan view of the packaged assembly of FIG. 10.

DESCRIPTION OF THE PREFERRED EMBODIMENT

The aims and objects of the invention are accomplished by providing in a tool package of the "skin-pack" type, a novel floor-like support for the tools, the support being characterized in that the marginal portions to which the transparent film of the skin pack has been bonded are turned under the assembly so as to effect a material saving in space. The invention has particular utility in that type of package in which the skin pack assembly is housed in a tool box or carrying case of metal construction, or the like.

Referring now to the drawings, and more particularly to FIGS. 1, 2, 5 and 7, there is shown one preferred embodiment of the packaging assembly of the invention provided for illustrative purposes and not to be construed in any limiting sense. The composite assembly 20, ready for insertion into a tool box or carrying case 24 (FIG. 3), is shown in FIG. 1 as including a plurality of tool elements 30, consisting, in the specific example shown, of a socket set 34, a ratchet handle 36, a drive handle 40, special adapters 42, and a socket-retaining organizer 46. The tool elements are arranged to occupy substantially the entire surface area overlying a baseboard or backing panel 50 which may be of cardboard composition, plastic, or any other suitable material having the requisite firmness and rigidity.

Interposed between the baseboard 50 and the tool elements 30 is a floor sheet 54 (FIG. 7). The floor sheet 54 extends laterally beyond the baseboard 50 at opposed parallel side edges 56 and 58 of the baseboard 50 so that the extending or projecting portions of the floor sheet 54 define a pair of flanges 62 and 64 extending marginally along the floor sheet 50 and outwardly of the opposed side edges 56 and 58 of the baseboard 50, along the length thereof.

As indicated in FIG. 8, with the tool elements 30 positioned in place on the floor sheet 54 in a zone overlying the areal expanse of the baseboard 50, a cover film 70 of thin transparent plastic sheet material is superimposed over the tool elements 30 and brought into contact with to bond to the laterally extending flanges 62 and 64 of the floor sheet 54. Applying film shrinking techniques of the type well known in the art, the plastic film 70 is subjected to heat and vacuum so that the film 70 is shaped and formed snugly to engage the tool elements and to secure the latter fixed in place on the floor 54 and base 50 elements.

In order to ensure and to facilitate the "encasement," the sandwiched baseboard 50 and overlying floor sheet 54 are provided with a plurality of die-cut through slots 80 as an aid to the evacuation of air from the tool-containing chamber 84 bounded by the floor sheet 54 and the overlying plastic film 70 so that the film may be effectively drawn into close and confining contact with the tool elements 30.

With the plastic film 70 shrunken about the tool elements 30, and with the borders 88 and 90 of the film 70 bonded to the marginal flanges 62 and 64 of the floor sheet 54, the flanges 62 and 64 are bent downwardly about fold lines delineated by the ends 56 and 58 of the baseboard 50 (FIG. 9), and folded to underlie the baseboard 50 against the undersurface 94 thereof in substantial contiguous relationship therewith, as indicated schematically in FIG. 10.

With the tool components 30 secured in place by the shrink film 70, and the floor sheet 54, to which the transparent film 70 has been bonded, having been folded under the supporting baseboard 50 of the composite assembly, the assembly is conveniently placed in a tool box or carrying case 100 which may be fabricated of sheet metal or any other preferred structural material, typically as illustrated in FIG. 3.

It will be appreciated upon consideration of the above set forth description, in conjunction with the illustrative drawings, that the tool assembly of the invention occupies a minimal space and that, upon removal of the skin packing film by the purchaser of the article, the various tool components will occupy, in the tool box 100, essentially the same spaces or locations, and in the same arrangement, as when secured in the skin packing. Conversely, it is possible, in accordance with the present invention, to provide a metal tool box which has a floor area corresponding essentially to the minimal floor area required for accommodating the tool elements themselves, with no additional "waste" space for accommodating peripheral seal flange areas. Since the seals of the present invention bond over a substantial area (folded under the baseboard), the final assembly has a high degree of structural stability and physical security and is not subject to premature failure during handling or during the "display" period of use. In any display presentation such as that indicated in FIG. 3, the individual tool elements are protected, to some degree, against pilferage. Additionally, the tool elements are maintained in an organized arrangement, which is aesthetically pleasing and sales promoting.

While the present invention has been described with respect to a preferred embodiment and with reference to specific structural materials, and an illustrative application, the invention is not to be narrowly construed. For example, while the supporting substrate on which the tools are located has been described as consisting of a baseboard and an overlying floor sheet, it is contemplated that a single element may be used if preferred. Such an alternative arrangement would be facilitated by providing the supporting sheet with prescored fold lines to facilitate the underfolding of the lateral flanges after the heat seal or bonding operation has been completed. Also, while the baseboard and the overlying floor sheet have been described as constructed of cardboard or paperboard, it is evident that other structural materials including plastic may be equally suitable. The overlying film may be any of various plastic compositions including cellulose, vinyl plastics or polyalkylenes such as polyethylene. The mode of securement of the cover film may be by conventional heat-sealing bonding techniques or may be through the application of pressure in combination with other securement expedients such as adhesives.

From the foregoing, it is to be understood that the package assembly of the invention is capable of modifications and that such modifications may be made without departure from the spirit and scope of the invention as defined in the appended claims.

What is claimed is:

1. In the packaging of hardware items such as hand tools to house and display tools in a container such as a rigid tool box or carrying case, a space-conserving covered package assembly, said package assembly sized to fit within the tool box with peripheral borders of said package in close proximity to upstanding bounding walls of said tool box, said package assembly comprising:

baseboard means of semi-rigid sheet stock for support of tool elements placed thereon, the shape and areal configuration of said baseboard means being essentially congruous to a floor area of a case in which said package assembly is to be inserted, floor sheet means for attachment of a tool retaining film thereto, said floor sheet means extending laterally beyond said baseboard means at a pair of opposed parallel edges thereof to demark a pair of fold lines and to delineate a corresponding pair of flanges extending marginally along said floor means and outwardly of said opposed side edges of said baseboard means along the length thereof, a plurality of tool elements arranged on said floor sheet means interiorly of said fold lines and in a zone corresponding to said baseboard means, said tool elements being supported on said baseboard means, a cover film of transparent plastic superimposed on so as snugly to confine said tool elements for securing said tool elements fixed in place in said package assembly, bonding means bonding said film to said flanges of said floor sheet means over a substantial surface area of said flanges, said flanges with said film bonded thereto being folded under said baseboard means at said fold lines to lie contiguously against said baseboard means at an undersurface thereof, whereby substantially the entire floor area of the case is occupied by said tool elements to effect substantial conservation of space and to provide a pilfer-resistant display.

2. The structure as set forth in claim 1 wherein said baseboard means and said floor sheet means are of a unitary construction.

3. The structure as set forth in claim 1 wherein said floor sheet means and said baseboard means are distinct elements, and wherein said floor sheet means is bonded to said baseboard means over substantially the entire areal expanse thereof.

4. The structure as set forth in claim 1 wherein said cover film is a heat-shrinkable film contoured to engage and bear upon said tool elements arranged on said floor sheet means.

5. The structure as set forth in claim 1 wherein said cover film includes strip portions linearly coextensive with and extending laterally beyond said flanges to which said film is bonded.

6. A method of forming a space conserving, secured package assembly of tool elements and the like, said method comprising:

superimposing bendable floor sheet means on a semi-rigid underlying baseboard means to cover an expanse of said baseboard means, and to provide a pair of laterally opposed marginal portions of said floor sheet means projecting beyond parallelly extending lateral limits of said baseboard means, thereby to define a pair of flanges extending laterally along substantially the entire length of said baseboard means and outwardly therefrom, placing at least one tool element on said floor sheet means in an areal zone thereof overlying said baseboard means to occupy a substantial portion of said areal zone, positioning a transparent plastic film over said tool element and said floor sheet means, shaping said film over to confine said tool element, and bonding said film to said marginal portions of said floor sheet means to encase said tool element, folding said flanges with said film attached thereto under said baseboard means along opposed side edges thereof to provide a compact, unitary package assembly in which essentially the entire area of said baseboard means is occupied by said tool element, and placing said assembly in a box having a floor area essentially congruous to the area of said baseboard means to provide a pilfer-proof package display of said tool element.

7. The method as set forth in claim 6 and further comprising the step of securing said floor sheet means to said underlying baseboard means prior to placement of said tool element on said floor sheet means.

* * * * *